US009797174B2

(12) United States Patent
Buschmann

(10) Patent No.: US 9,797,174 B2
(45) Date of Patent: Oct. 24, 2017

(54) HINGE FOR FURNITURE OR DOMESTIC APPLIANCES

(71) Applicant: HETTICH-ONI GMBH & CO. KG, Vlotho (DE)

(72) Inventor: Alexander Buschmann, Herford (DE)

(73) Assignee: Hettich-Oni GMBH & Co. KG, Vlotho (DE)

( * ) Notice: Subject to any disclaimer, the term of this patent is extended or adjusted under 35 U.S.C. 154(b) by 0 days.

(21) Appl. No.: 15/311,596

(22) PCT Filed: May 13, 2015

(86) PCT No.: PCT/EP2015/060686
§ 371 (c)(1),
(2) Date: Nov. 16, 2016

(87) PCT Pub. No.: WO2015/173351
PCT Pub. Date: Nov. 19, 2015

(65) Prior Publication Data

US 2017/0081890 A1 Mar. 23, 2017

(30) Foreign Application Priority Data

May 16, 2014 (DE) ..... 10 2014 106 911

(51) Int. Cl.
*E05D 11/10* (2006.01)
*E05F 1/14* (2006.01)
(Continued)

(52) U.S. Cl.
CPC ..... *E05D 11/1021* (2013.01); *E05D 3/142* (2013.01); *E05F 1/14* (2013.01);
(Continued)

(58) Field of Classification Search
CPC ..... E05D 11/1021; E05D 3/142; E05F 1/14; E05F 5/006; E05Y 2201/21;
(Continued)

(56) References Cited

U.S. PATENT DOCUMENTS 7,730,583 B2 * 6/2010 Salice ..... E05D 11/1021 16/262
7,757,348 B2 * 7/2010 Salice ..... E05D 11/1021 16/286
(Continued)

FOREIGN PATENT DOCUMENTS

EP 1809843 7/2005
EP 2093361 8/2009
(Continued)

OTHER PUBLICATIONS

International Search Report of PCT/EP2015/060686 dated Aug. 19, 2015.
(Continued)

*Primary Examiner* — William Miller
(74) *Attorney, Agent, or Firm* — Barnes & Thornburg LLP

(57) ABSTRACT

The disclosure relates to a hinge for furniture or domestic appliances, comprising a lateral part on which a hinge part is pivotally mounted via two levers. A damping device is provided having a movable damping element which is mounted in a movable manner between guide elements for damping purposes and which can be moved via a first actuation element during a closing movement of the hinge before reaching the closed position. A second actuation element is provided which pushes the damping element during an opening movement of the hinge before reaching the maximum opening position for damping an opening
(Continued)

process. In this manner, the hinge provides an opening as well as a closing damping function.

9 Claims, 6 Drawing Sheets

(51) Int. Cl.
*E05F 5/00* (2017.01)
*E05D 3/14* (2006.01)

(52) U.S. Cl.
CPC ..... *E05F 5/006* (2013.01); *E05Y 2201/21* (2013.01); *E05Y 2201/254* (2013.01); *E05Y 2201/266* (2013.01); *E05Y 2201/604* (2013.01); *E05Y 2201/622* (2013.01); *E05Y 2201/638* (2013.01); *E05Y 2800/296* (2013.01); *E05Y 2800/73* (2013.01); *E05Y 2900/20* (2013.01); *E05Y 2900/30* (2013.01); *Y10T 16/54026* (2015.01)

(58) Field of Classification Search
CPC ..... E05Y 2201/254; E05Y 2201/266; E05Y 2201/604; E05Y 2201/622; E05Y 2201/638; E05Y 2800/296; E05Y 2800/73; E05Y 2900/20; E05Y 2900/30; Y10T 16/54026; Y10T 16/5383; Y10T 16/53832; Y10T 16/27; Y10T 16/299; Y10T 16/625; Y10T 16/53824; Y10T 16/304; Y10T 16/53833; Y10T 16/2771
USPC .... 16/333, 286–288, 49, 65, 85, 282, 50, 54
See application file for complete search history.

(56) References Cited

U.S. PATENT DOCUMENTS

| | | | | |
|---|---|---|---|---|
| 8,091,176 | B2 * | 1/2012 | Salice | E05D 11/087 16/286 |
| 8,464,394 | B2 * | 6/2013 | Salice | E05F 5/006 16/286 |
| 8,707,520 | B2 * | 4/2014 | Salice | E05F 5/006 16/286 |
| 2004/0103499 | A1 * | 6/2004 | Egger | E05D 11/087 16/242 |
| 2007/0136990 | A1 | 6/2007 | Salice | |
| 2008/0201906 | A1 | 8/2008 | Salice | |
| 2008/0276426 | A1 | 11/2008 | Salice | |
| 2009/0049645 | A1 * | 2/2009 | Salice | E05D 11/1021 16/250 |
| 2010/0205775 | A1 * | 8/2010 | Salice | E05D 11/087 16/337 |
| 2010/0293752 | A1 | 11/2010 | Salice | |

FOREIGN PATENT DOCUMENTS

| | | |
|---|---|---|
| EP | 2265787 | 12/2010 |
| WO | 2006051074 | 5/2006 |
| WO | 2007068740 | 6/2007 |
| WO | 2009115171 | 9/2009 |

OTHER PUBLICATIONS

English translation of International Search Report of PCT/EP2015/060686 dated Aug. 19, 2015.
Search Report issued in German Application No. 102014106911.0 dated Jun. 30, 2014.

* cited by examiner

Fig. 5
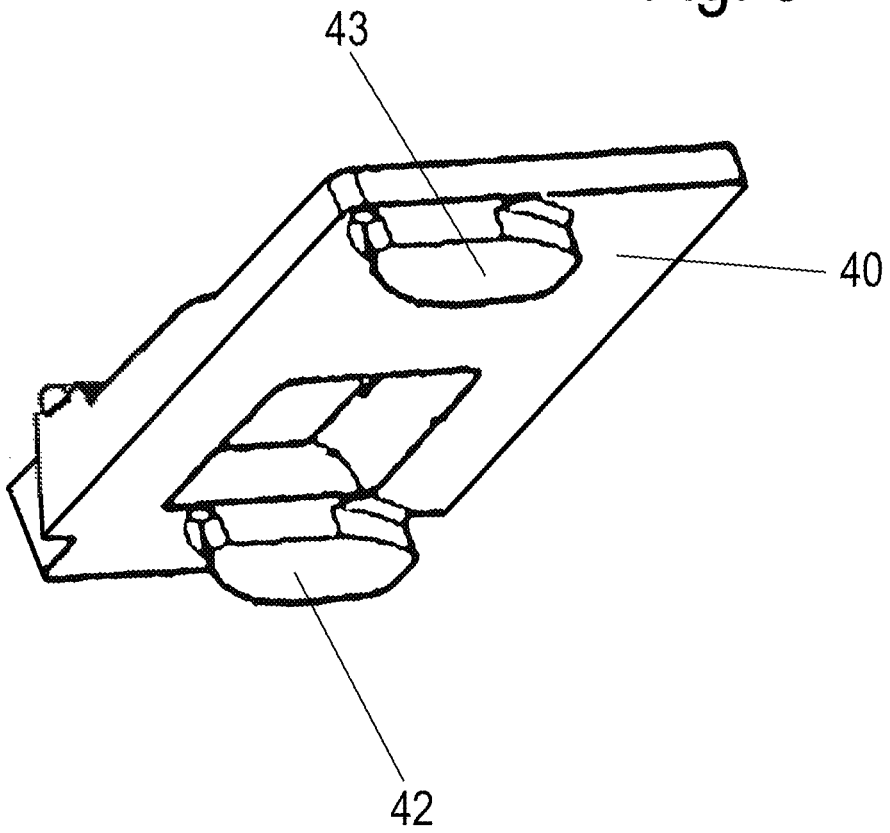
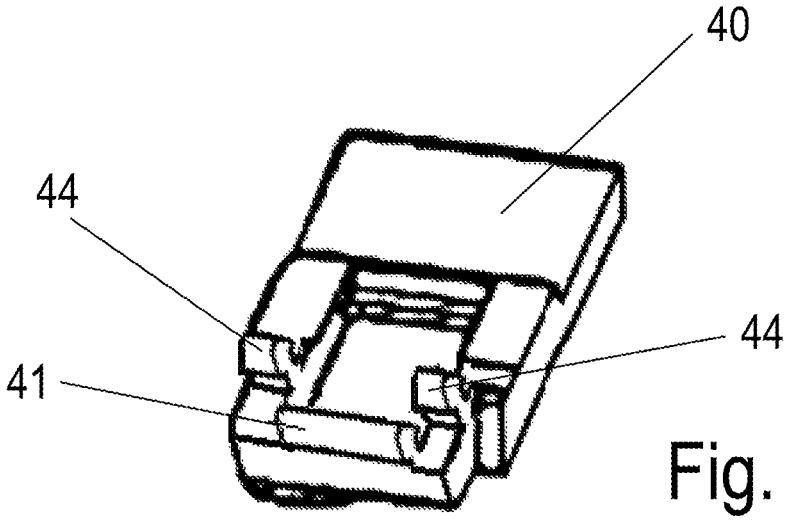
Fig. 6

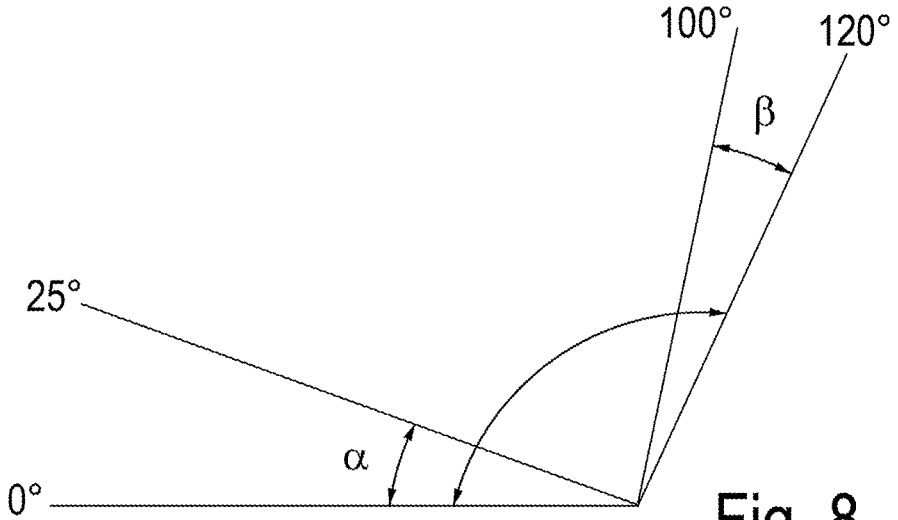
Fig. 8
Fig. 9
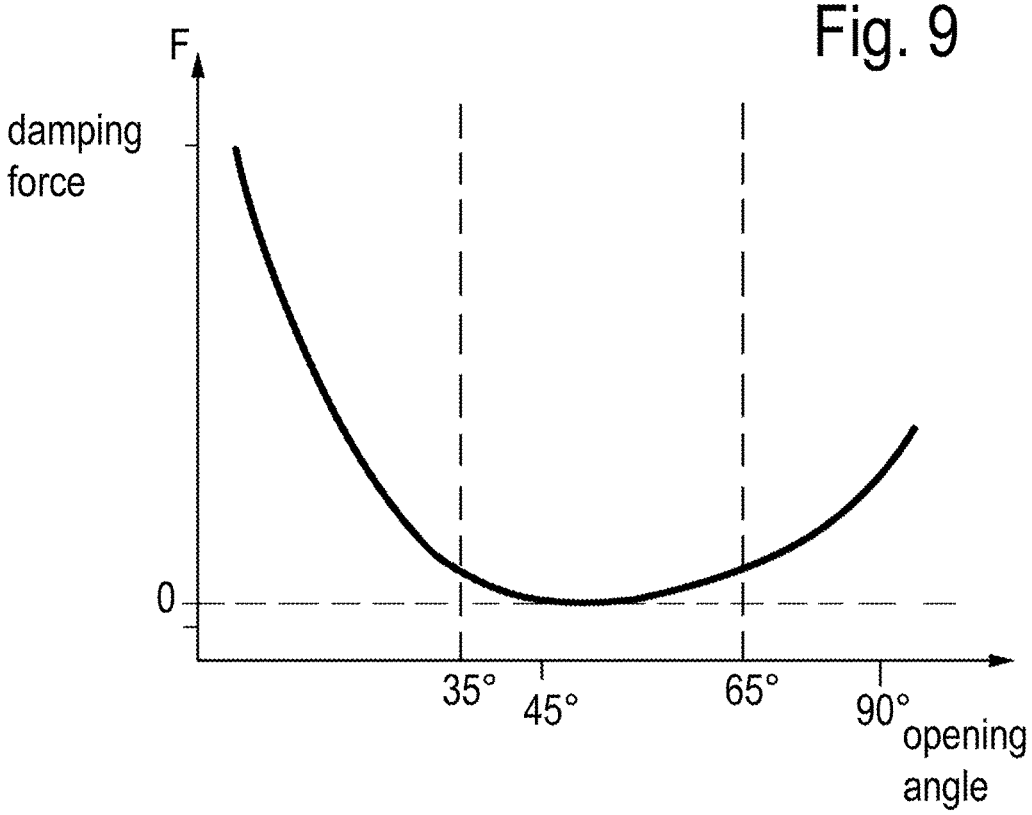

HINGE FOR FURNITURE OR DOMESTIC APPLIANCES

CROSS REFERENCE TO RELATED APPLICATIONS

This application is a U.S. nationalization under 35 U.S.C. §371 of International Application No. PCT/EP2015/060686, filed May 13, 2015, which claims priority to German Application No. 102014106911.0 filed May 16, 2014.

BACKGROUND AND SUMMARY OF THE DISCLOSURE

The present disclosure relates to a hinge for furniture or domestic appliances, having a side part, on which a hinge part is mounted so it is pivotable via two levers, wherein a damping device is provided, which has a movable damping element, which is mounted so it is displaceable or pivotable between guide elements for damping, and is movable via a first actuating element during a closing movement of the hinge before reaching the closed position.

EP 2 265 787 discloses a hinge, in which a damping device is provided on a hinge part. The damping device comprises a rotatable friction disk, which is rotated via an actuating element and a slide during the closing of the hinge. The closing movement is slowed and damping is provided by the rotation of the friction disk. Such a hinge has the problem that the load of the hinge part is comparatively high during an opening movement. In particular due to the multipart construction of the hinge part having the damping device, damage can occur on the hinge during rapid opening.

The present disclosure illustrates and describes a hinge in which the handling is improved.

According to the present disclosure, the hinge comprises a damping device, which provides closing damping during a closing movement of the hinge before reaching the closed position and additionally provides opening damping during an opening movement of the hinge before reaching the maximally open position. A movable damping element is provided for this purpose, which is displaceable or pivotable via a first actuating element for the closing damping and is displaceable or pivotable via a second actuating element for opening damping. The first and second actuating elements can act directly on the slide in this case or also with further components interposed. The handling of the hinge is thus improved, because the hinge is also decelerated via the damping device before reaching the maximally open position. The damping device can be used in this case both for the opening damping and also the closing damping.

The opening damping of the damping device may be active at least 10°, for example, at least 20° before reaching the maximally open position. The opening damping can be active in this case depending on the maximum opening angle of the hinge, so that the damping device can be adapted flexibly to different hinge types.

For a compact construction having only few components, the first and/or the second actuating element can be fixed on one of the levers of the hinge or can be formed integrally with one of the levers. During a rotational movement of the lever, the movement can thus be used to cause a movement of the damping element.

The damping device can be active at least 10°, for example, more than 20°, before the closing position in this case. Furthermore, the damping device can be inactive in a middle region between closing damping and opening damping both in the opening direction and also in the closing direction. The damping device may be inactive at least in an angle range between 40° and 60° of the hinge part viewed from the closed position. The damping device thus does not obstruct an opening or closing movement in a middle angle range, which could be perceived to be annoying by a user.

In an embodiment, the damping element can be formed on the hinge part as a rotatably mounted friction disk, so that a large friction surface is available. The friction surface can be enlarged in this case by a profile, for example, ring-shaped ribs or grooves. In this case, the damping element can have at least one control curve or can interact with such a control curve, wherein at least one driver of a slide is engaged with the control curve, which is in turn engaged with the first and/or second actuating element. The actuating element therefore firstly acts on the slide, which rotates the damping element via a driver and the control curve. It is also possible that the first and/or second actuating element acts directly on the damping element to provide damping. However, the force distribution from the first and/or second actuating element to the damping element can be optimized via the interconnection of a slide.

The actuating elements can have at least one arm, preferably at least two arms, by means of which the slide can be displaced at least over a specific angle range of the hinge, to generate the damping forces in the opening and closing directions.

BRIEF DESCRIPTION OF THE DRAWINGS

FIGS. 5 and 6 show two views of a slide of the damping device;

FIG. 8 shows a diagram of the opening and closing damping, and

FIG. 9 shows a diagram of the damping force as a function of the opening angle.

DETAILED DESCRIPTION OF THE DRAWINGS

Figure 1:
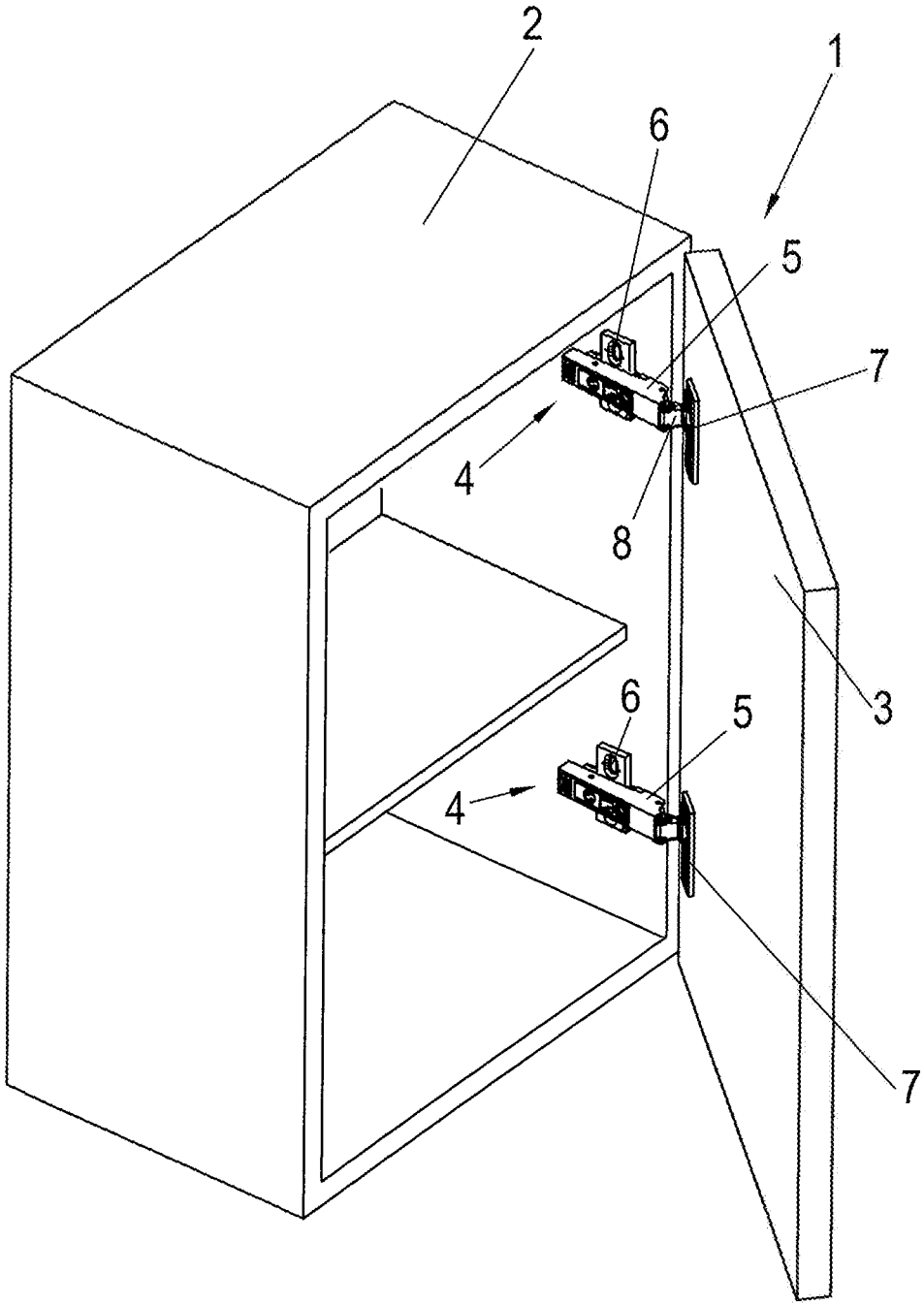
FIG. 1 shows a perspective view of an item of furniture having two hinges according to the present disclosure.

An item of furniture 1 comprises a cabinet-shaped furniture body 2, on which a pivotable door 3 is provided. The door 3 is held so it is pivotable on a side wall of the furniture body 2 via two hinges 4 in this case.

Each hinge 4 comprises a side part 5, which is fixed via an installation plate 6 on the side wall of the furniture body 2. Two levers 8, 9 are provided on the side part 5, which carries a hinge part 7 so it is pivotable via a four-joint connection. The door 3 is held on the hinge part 7. Each hinge part 7 is designed as cup-shaped in this case and comprises a damping device 10.

Figure 2:
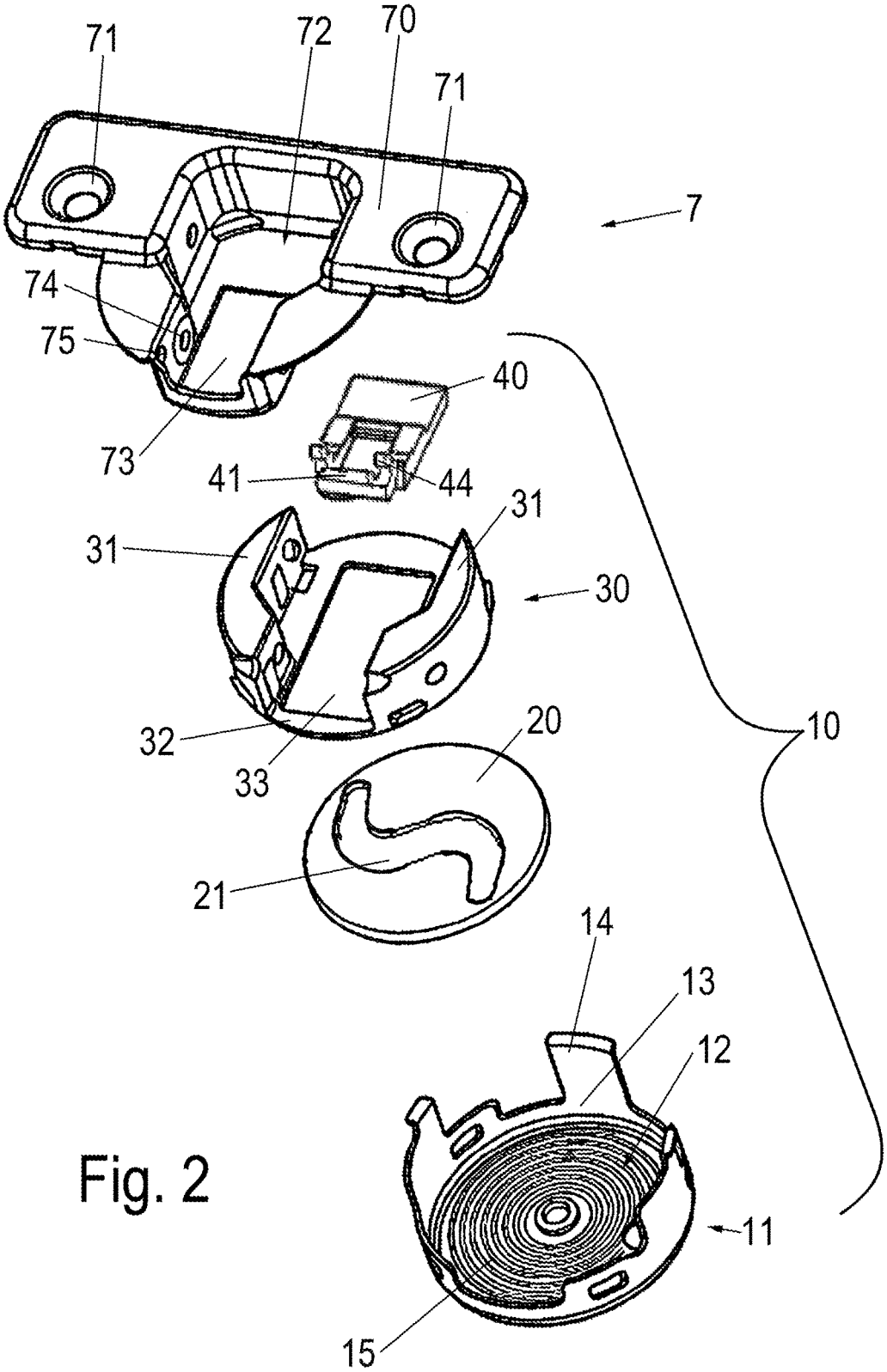
FIG. 2 shows a perspective exploded view of the damping device of the hinge of FIG. 1.

The hinge part 7 having the damping device 10 is shown in detail in FIG. 2. The hinge part 7 comprises a plate 70, on which two openings 71 are left out for fastening screws, to fix the door 3 on the hinge part 7. Furthermore, a cup-shaped receptacle 72 is formed on the hinge part 7, on the bottom of which an opening 73 is left out, which provides access to the damping device 10. Openings 74 and 75 for accommodating an axis for linking on the levers 8 and 9 are also provided on the cup-shaped receptacle 72 on the side walls.

Figure 3:
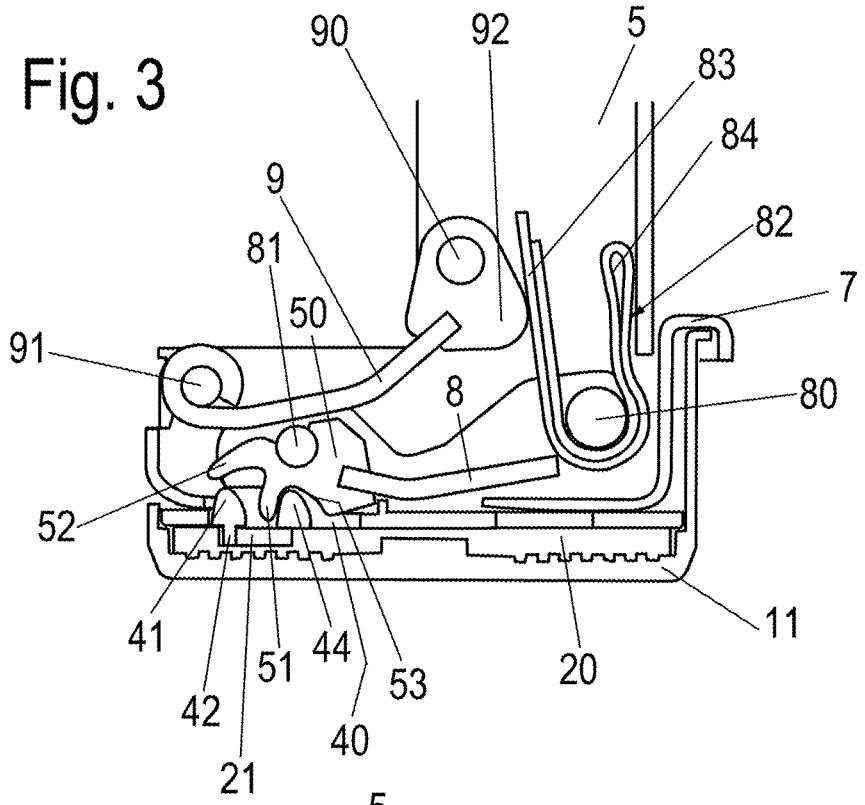
FIG. 3 shows a sectional view of the hinge part having the damping device in a closed position.

The damping device 10 shown in FIG. 3 comprises a cup-shaped housing 11, which has a plurality of ring-shaped ribs 15 on a bottom 12, which can be coated with a fluid and are engaged with ribs or rings on the lower side of a disk-shaped damping element 20. The housing 11 furthermore comprises side walls 13 having projections 14, which can be latched on a holder 30 or the hinge part 7.

The holder 30 is fixed on the lower side of the hinge part 7 and comprises two side walls 31, which are fixed on the outer side of the cup-shaped receptacle 72. A rectangular opening 33 is provided on a bottom 32 of the holder, which is used for guiding a slide 40, which is guided within the opening 33. A first projection 41, which protrudes upward through the opening 73 on the hinge part 7, is provided on the slide 40. Two second projections 44 are provided adjacent to the first projection 41, which protrude from the plate-shaped slide 40 and are arranged offset in relation to the first projections 41 both in the sliding direction and also in a direction perpendicular to the sliding direction.

The damping device comprises the disk-shaped damping element 20, which is guided between the holder 30 and the cup-shaped housing 11. The damping element 20 is arranged so it is rotatable in this case and has a control curve 21 in the form of a curved slot, which can be designed as U-shaped or S-shaped, for example, and which interacts with a driver 42 on the slide 40. The shape of the control curve 21 can be modified to change the level of the damping force and the angle range in which the damping force is to be generated.

FIG. 3 shows the hinge part 7 of the hinge 4 in a closed position. The levers 8 and 9 are arranged in the receptacle 72 of the hinge part 7, wherein the lever 8 is mounted so it is rotatable via an axis 80 and the lever 9 is mounted so it is rotatable via an axis 90 on the side part 5. The lever 8 is held so it is rotatable via an axis 81 and the lever 9 is held so it is rotatable via an axis 91 on the hinge part 7, so that a four-joint connection is provided between the side part 5 and the hinge part 7. A U-shaped spring 82 is arranged about the axis 80, one leg 84 of which presses against the side part 5 and the other leg 83 of which presses against a projection 92 of the lever 9. During the opening of the hinge 4, the spring 82 is initially compressed, so that the spring 82 holds the hinge 4 in a closed position.

A rotating part 50, which is rotatable together with the lever 8 about the axis 81, is arranged on the lever 8 about the axis 81. A first actuating element 51 and a second actuating element 52 are provided on the rotating part 50. The first actuating element 51 encloses the first projection 41 and the second actuating element 52 encloses the second projection 44 on the slide 40 essentially in a U shape. During a rotation of the lever 8 and the rotating part 50 out of the closed position (FIG. 3), the slide 40 is displaced by the action of the first and second actuating elements 51 and 52 on the first and second projections 41 and 44. Due to the displacement of the slide 40, the drivers 42 and 43 on the lower side of the slide 40 are moved in the control curve 21 and therefore ensure a rotation of the damping element 20, which damps the movement of the hinge in the opening and closing directions. During a rotation of the lever 8 and the rotating part 50 from the open position into the closed position, the slide 40 is also displaced by the action of the first and second actuating elements 51 and 52 on the first and second projections 41 and 44, but in the opposite direction. By adapting the shape and positions of the actuating elements 51 and 52, and also the shape of the control curve 21, the damping range can therefore be predefined in the opening and closing directions.

Figure 4:
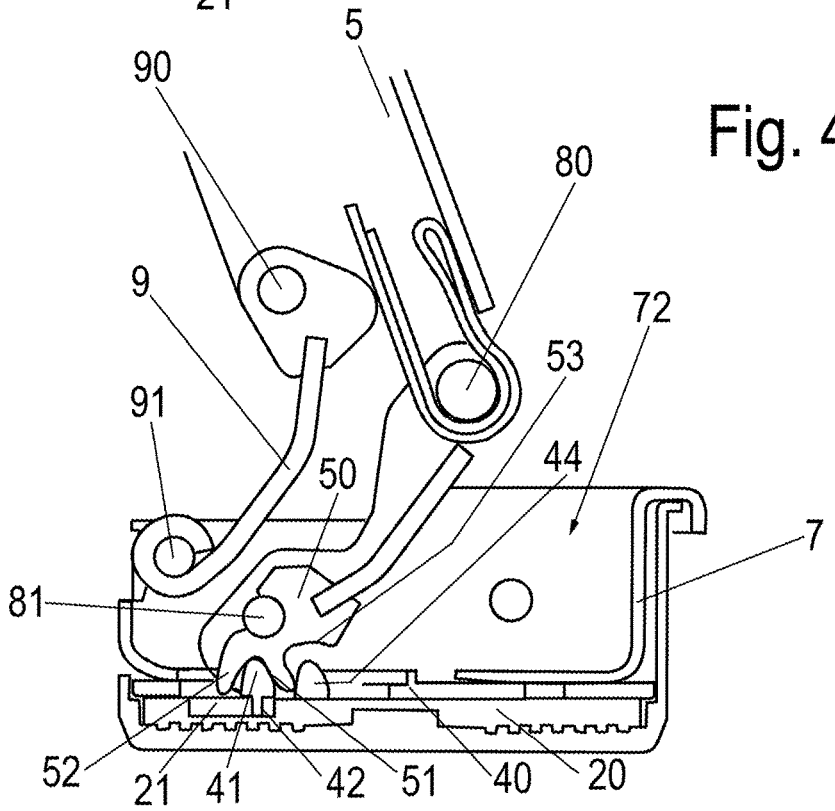
FIG. 4 shows a sectional side view of the hinge part having the damping device in an open position.

FIG. 4 shows the hinge 4 in an open position, in which the hinge part 7 was pivoted by approximately 80° in relation to the side part 5. The levers 8 and 9 have thus been rotated about the respective axes 80, 90, 81, 91, wherein the rotating part 50 was additionally rotated about the axis 81. During a further opening movement, the slide 40 is now displaced in the opening 33 of the holder 30 and thus moves the damping element 20 via the driver 42 and the control curve 21. The damping element 20 rotates on the bottom of the housing 11, wherein the ribs 15 provided between the damping element 20 and the bottom 12 are engaged and generate the required braking forces. The hinge 4 can therefore also provide opening damping, wherein before the maximally open position, the slide 40 for rotating the damping element 20 is moved to decelerate a movement before the maximally open position.

Figure 7A:
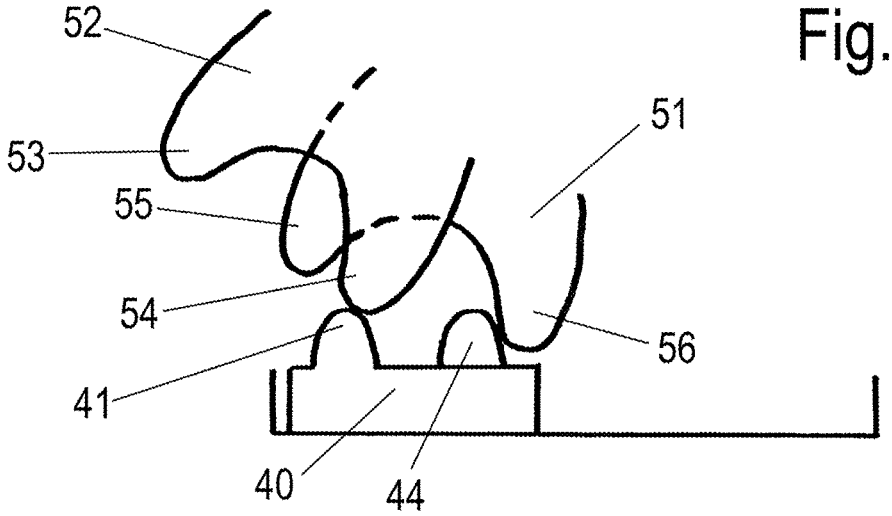
FIGS. 7A to 7C show multiple views of the slide of the damping device in different positions me.
Figure 7B:
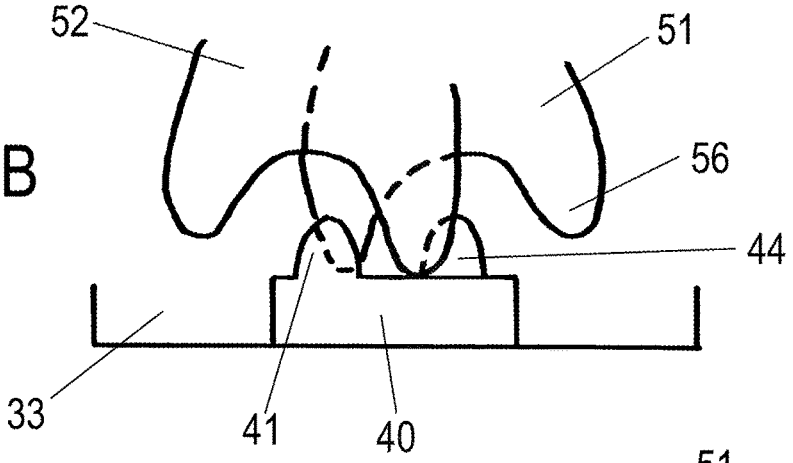
Figure 7C:
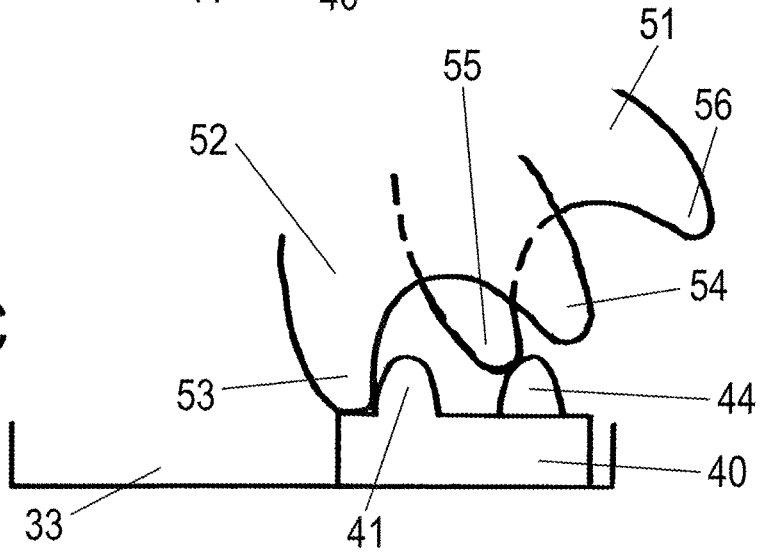

The actuating elements 51 and 52 and the slide 40 are shown in different positions in FIGS. 7A to 7C. The first actuating element 51 comprises two arms 55 and 56, which enclose the projection 44 in a U shape, while the second actuating element 52 has arms 53 and 54, which enclose the projection 41 in a U shape. The projections 41 and 44 and the actuating elements 51 and 52 are located in different planes, so that the first actuating element 51 only acts on the projection 44 and the second actuating element only acts on the projection 41.

The slide 40 is shown in the left position close to the closed position in FIG. 7A. The slide 40 is displaced along the opening 33 by the arm 55 into a middle position by an opening movement.

FIG. 7B shows a middle position, in which both actuating elements 51 and 52 are disengaged from the projections 41 and 44, i.e., the rotating part 50 can be rotated without damping forces. This free running can extend over an angle range of 30° to 70° from the open position.

In FIG. 7C, the slide 40 is located on the right side of the opening 33 and the hinge is close to the maximally open position. The arm 53 presses against the projection 41 and can therefore displace the slide 40 to generate damping forces for opening damping.

If the hinge 4 is now moved out of the maximally open position in the closing direction, the arm 54 presses against the projection 41, wherein the slide 40 is displaced into a middle position.

The contour of the actuating elements 51 and 52 and the projections 41 and 44 can be adapted so that, in conjunction with the control curve 21 and the driver 42, damping only occurs in predetermined angle ranges during the opening and closing of the hinge 4. The damping device 10 ensures damping both in the opening direction and also in the closing direction in this case.

FIGS. 5 and 6 show the slide 40, in which two drivers 42 and 43 are provided on the lower side, while a first projection 41 and a second projection 44, which can be engaged with the actuating elements 51 and 52, are provided on the upper side. By providing two drivers 42 and 43, two curve guides can also be provided on the damping element 20, wherein a first curve guide is engaged with the driver 42 and a second curve guide is engaged with the driver 43. It is thus possible that the driver 42 is active for damping in the closing direction in a first angle range and the driver 43 is active for damping in the opening direction in a second angle range. Instead of the two drivers 42 and 43, only one driver can also be provided on the lower side of the slide 40.

In addition, it is possible to reduce or increase the number of the actuating elements 51 and 52. The number, shape, and position of the projections 41 and 44 on the slide 40 can also be varied to achieve optimum damping forces.

FIG. 8 schematically shows the principle of the opening and closing directions. In an embodiment of the hinge, closing damping takes place in a first angle range α between 0° and 25°, for example, also between 0° and 40°, wherein the hinge part 7 is decelerated by the damping device 10 during a corresponding closing movement in this angle range. In the opening direction, the damping device is then moved back mechanically, wherein the damping forces also have to be overcome in the opening direction. Furthermore, the hinge 4 has opening damping, which is active, for example, in an angle range between 100° and 120° if the hinge part 7 may be opened into a maximally open position of 120°. The opening damping is then active in a range of at least 20° beforehand, so that opening damping is active before reaching the maximally open position. During a closing movement, the damping device 10 is then mechanically reset again, so that the damping forces also have to be overcome during a closing movement in the angle range between 120° and 100°. In a middle range, for example, between 25° and 100°, in contrast, essentially no damping takes place. In this range, the user may wish to obtain easy handling of the hinge 4, so that damping forces would only interfere. The ranges in which no damping is active, for example, between 40° and 60° or 30° and 75°, can be selected depending on the hinge type and as a function of the maximum opening angle.

FIG. 9 shows the damping force as a function of the opening angle. The damping force can be varied as a function of the opening angle by appropriate embodiment of the control curve 21, the drivers 42 and 43, the projections 41, 44, and the actuating elements 51 and 52. For example, a particularly high damping force is to be obtained during the closing damping shortly before reaching the closed position, to avoid slamming of the door 3. However, the damping force is still to be lower than the force of the spring 82 before reaching the closed position, so that self-retraction is ensured. The damping force can therefore be particularly high shortly before a closed position and can then be reduced up to an angle of, for example, 35°. In a middle range of, for example, 35° to 65°, essentially no damping takes place, so that smooth pivoting of the hinge 4 is possible. If the hinge 4 is movable up to a maximally open position of, for example, 90°, the opening force can begin from an angle of, for example, 65° to 70° and then generate a damping force. The damping force in the opening direction can be selected to be somewhat less than in the closing direction, but an equal or greater damping force can also be used.

In the present exemplary embodiment, a rotating part 50 is provided about the axis 81. It is also possible to form the first and second actuating elements 51 and 52 integrally with the lever 8. In addition, it is possible to omit the slide 40 if the actuating elements 51 and 52 act directly on the damping element 20. Instead of the mechanism shown for transmitting the rotational movement from the lever 8 to the damping element 20, other mechanisms can also be used to generate friction forces in a damping device 10, which then damp the hinge 4 in a closing range and an opening range.

The invention claimed is:

1. A hinge comprising:

a side part;

a hinge part pivotally mounted to the side part via two levers; and a damping device mounted to the hinge part, the damping device having a disc-shaped damping element between a holder and a cup-shaped housing, the damping element rotatable via a first actuating element during a closing movement of the hinge for closing damping before reaching the closed position, and rotatable via a second actuating element during an opening movement of the hinge for opening damping before reaching the maximally open position, wherein the damping element has at least one control curve in the form of an S-shaped or U-shaped slot engaged with at least one driver of a slide, which is in turn selectively engaged with the first actuating element and the second actuating element.

2. The hinge according to claim 1, wherein the opening damping of the damping device is active at least 10° before the maximally open position.

3. The hinge according to claim 1, wherein the first and/or the second actuating element is fixed on one of the levers or is integrally formed with one of the levers.

4. The hinge according to claim 1, wherein the damping device is active at least 10° before the closed position.

5. The hinge according to claim 1, wherein the damping device is inactive in a middle opening range between closing damping and opening damping both in the opening direction and also in the closing direction.

6. The hinge according to claim 5, wherein the damping device is inactive at least in an angle range between 40° and 60° of the hinge part viewed from the closed position.

7. The hinge according to claim 1, wherein the actuating elements have at least one arm, by means of which the slide is displaced at least over a specific angle range of the hinge.

8. The hinge according to claim 1, wherein the closing damping of the damping device is active at least 20° before the closed position.

9. The hinge according to claim 1, wherein the opening damping of the damping device is active at least 20° before the maximally open position.

* * * * *